US007586261B2

(12) United States Patent
Matsumoto

(10) Patent No.: US 7,586,261 B2
(45) Date of Patent: Sep. 8, 2009

(54) RARE GAS FLUORESCENT LAMP

(75) Inventor: Shigeyoshi Matsumoto, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 484 days.

(21) Appl. No.: 11/344,104

(22) Filed: Feb. 1, 2006

(65) Prior Publication Data

US 2006/0170343 A1 Aug. 3, 2006

(30) Foreign Application Priority Data

Feb. 2, 2005 (JP) ..... 2005-026854

(51) Int. Cl.
*H01J 17/20* (2006.01)

(52) U.S. Cl. ..... 313/576; 313/607; 315/291

(58) Field of Classification Search ..... 313/607, 313/576; 315/246, 291
See application file for complete search history.

(56) References Cited

U.S. PATENT DOCUMENTS 5,889,366 A * 3/1999 Yokokawa et al. ..... 313/607

FOREIGN PATENT DOCUMENTS

JP 08-329903 A 12/1996
JP 10-188910 A 7/1998
JP 2003123701 A * 4/2003

OTHER PUBLICATIONS

English translation of JP 2003123701A.*

* cited by examiner

*Primary Examiner*—Nimeshkumar D. Patel
*Assistant Examiner*—Mary Ellen Bowman
(74) *Attorney, Agent, or Firm*—Rader, Fishman & Grauer, PLLC

(57) ABSTRACT

The present rare gas fluorescent lamp can prevent reduction of an effective light-emitting region by securely suppressing creeping discharge even when a conductive material is provided to improve starting performance. The rare gas fluorescent lamp having a light-emitting tube whose inner surface is coated by a fluorescent material and which is filled with a rare gas, a plurality of external electrodes which are provided on an outer surface of the light-emitting tube, a conductive material, which is provided at an end portion of the light-emitting tube that corresponds to a portion on which the external electrodes are arranged, the rare gas fluorescent lamp, and a creeping discharge prevention unit that is provided inward of the conductive material in an axial direction to prevent diffusion of creeping discharge occurring between the conductive material and electrical charges stored on the inner surface of the light-emitting tube.

13 Claims, 6 Drawing Sheets

FIG. 7A
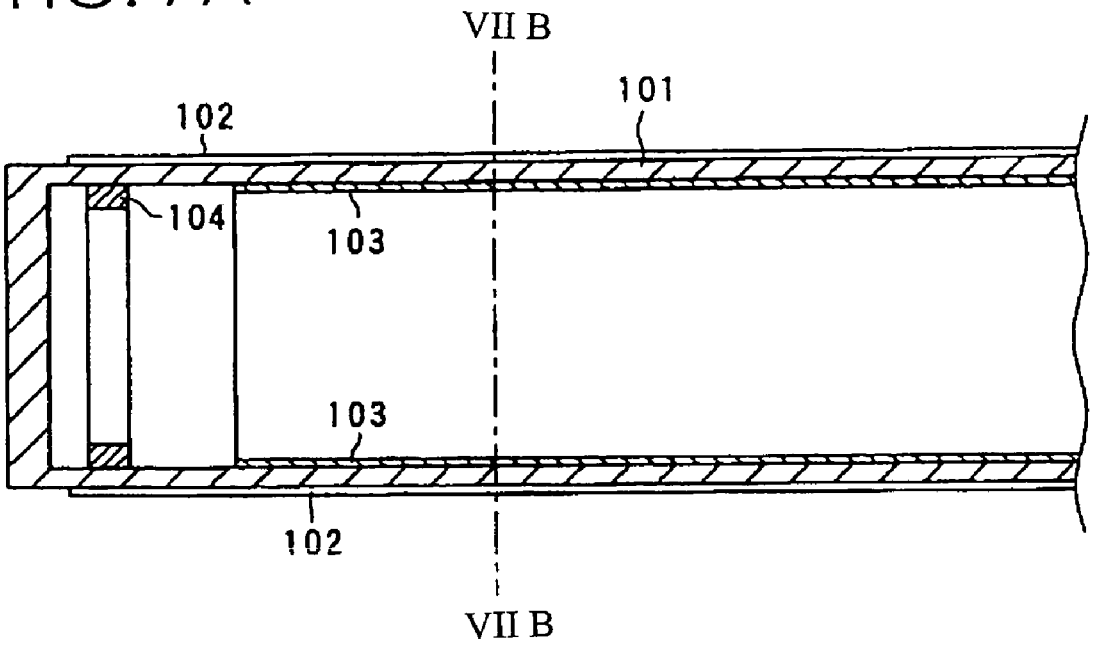
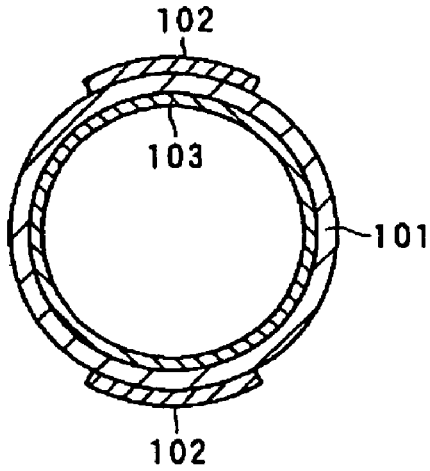
FIG. 7B

RARE GAS FLUORESCENT LAMP

RELATED APPLICATION

The disclosure of Japanese Patent Application No. 2005-026854, filed Feb. 2, 2005, including the specification, claims and drawings thereof, is incorporated herein by reference in its entirety.

TECHNICAL FIELD OF THE INVENTION

The present invention relates to a rare gas fluorescent lamp and, in particular, to a rare gas fluorescent lamp that includes a light-emitting tube whose inner surface is coated by a fluorescent material and which is filled with a rare gas, a plurality of external electrodes which is provided on an outer surface of the light-emitting tube, and a conductive material, which is provided on an inner surface of an end portion of the light-emitting tube that corresponds to a portion on which the external electrodes are arranged.

DESCRIPTION OF RELATED ART

Conventionally, as a fluorescent lamp used for a light source of a business machine or a backlight of a liquid crystal display panel, a rare gas fluorescent lamp has been widely used, in which a plurality of strip-shaped external electrodes is provided on an outer surface of a light-emitting tube, and a high frequency voltage is applied to the external electrodes to turn on the rare gas fluorescent lamp.

FIGS. 7A and 7B show an example of a conventional rare gas fluorescent lamp. FIG. 7A is a cross-sectional view of the rare gas fluorescent lamp in an axial direction, and FIG. 7B is a cross-sectional view of the rare gas fluorescent lamp taken along a line A-A of FIG. 7A. The rare gas fluorescent lamp includes a light-emitting tube 101, an external electrode 102, and a fluorescent substance 103. In the rare gas fluorescent lamp, the light-emitting tube 101 is filled with a rare gas, such as Xenon gas, and the external electrode 102 provided on an outer surface of the light-emitting tube 101 applies high frequency voltage through the light-emitting tube 101 made of a dielectric material to generate discharge in the light-emitting tube 101. Ultraviolet rays are radiated by the discharge. The ultraviolet ray excites the fluorescent substance 103 coated on an inner surface of the light-emitting tube 101 to generate visible light so that the visible light is emitted to the outside.

Even though the external electrode 102 is made from, for example, an aluminum tape, it is not limited to the strip-shaped tape. The external electrodes 102 may be formed in a line shape or a mesh shape. In addition, the external electrodes 102 may be made from a metal tape such as a copper tape, or a conductive pigment such as a silver paste, instead of the aluminum tape.

A conductive material 104 is provided in a peripheral direction of an inner surface at an end portion of the light-emitting tube 101 to form a short circuit over a region on an inner surface of the light-emitting tube 101 on which both the external electrodes 102 are arranged. Examples of the conductive material 104 include a carbon paste and a silver paste.

Functions of the conductive material 104 will be described. The conductive materials 104 provided in the glass tube 101 are provided over inner sides of both of the external electrodes 102. Since the areas occupied by the conductive materials are almost equal to each other, it has the same effect that capacitors having a substantially same capacitance are shorted by the same conductive materials 104. Thus, the conductive material 104 has an electric potential that is almost half of the potential of both of the external electrodes 102. On the other hand, since a discharge space has very large impedance before the discharge is initiated in the space, an inner wall of the light-emitting tube 101 provided on an inner side of the external electrode 102 has almost the same potential as that of the external electrode 102. As a result, since very high electric field is applied between the conductive material 104 and the vicinity of the conductive material 104 on the inner wall of the light-emitting tube 101 provided on the inner side of the external electrode 102, a desired preliminary discharge is generated. Thus, it becomes easy to generate main discharge. Since the preliminary discharge causes a lamp to be started, it is possible to generate the main discharge without failure of starting even when a low voltage is applied. Refer to, for example, Japanese Patent No. 3149780 Japanese Unexamined Patent Application Publication No. 10-188910.

SUMMARY OF THE INVENTION

In general, a rare gas fluorescent lamp includes a region (hereinafter referred to as 'effective light-emitting region') for ensuring a predetermined output, and the remaining region (hereinafter referred to as 'dead space'). The rare gas fluorescent lamp is preferably configured such that the effective light-emitting region is wide and the dead space is narrow in terms of space-saving design.

However, there is a problem in the conventional rare gas fluorescent lamp in that an undesired creeping discharge is extensively formed on an inner surface of the light-emitting tube due to the conductive material provided on the light-emitting tube for improving starting performance, thereby increasing a dead space and reducing an effective light-emitting region. That is, in the case the conductive material is provided, the starting performance is improved due to generation of preliminary discharge, but extensive creeping discharge is generated on end portions of the light-emitting tube, thereby reducing the effective light-emitting region.

A cause of the above-mentioned problem will be described with reference to FIG. 8.

When high voltage is applied to the external electrode 102, high voltage is generated in a discharge space within the light-emitting tube 101 to cause discharge. As shown in FIG. 8, as the discharge proceeds, electrons within the discharge space are accumulated on an inner wall of the light-emitting tube 101 located on a positive (+) potential side of the external electrode 102, and positive ions are accumulated on an inner wall of the light-emitting tube 101 located on a negative (−) potential side of the external electrode 102. Consequently, an electric field generated by the accumulated charges offsets an electric field generated by the external electrode 102, thereby stopping the discharge. A large amount of accumulated charges try to stay on the inner wall of the light-emitting tube 101, while the accumulated charges adjacent to the conductive material 104 try to move through the conductive material 104 having small resistance within the light-emitting tube 101. When the charges adjacent to the conductive material 104 are removed, neighboring charges are drawn, such that charges move along the inner wall of the light-emitting tube 101 that is, creeping discharge occurs. Since charges are not stored on a region on which the creeping discharge occurs, it is difficult for discharge to occur in the next discharge cycle. As a result, it is not possible to generate ultraviolet rays required for exciting the fluorescent substance, thereby reducing the effective light-emitting region.

The present rare gas fluorescent lamp can prevent reduction of an effective light-emitting by securely suppressing extensive spread of creeping discharge on an inner surface of a light-emitting tube even when a conductive material is provided so as to improve the starting performance.

In order to solve the above-mentioned problems, the rare gas fluorescent lamp having a light-emitting tube whose inner surface is coated by a fluorescent material and which is filled with a rare gas, a plurality of external electrodes which are provided on an outer surface of the light-emitting tube, and a conductive material, which is provided at an end portion of the light-emitting tube that corresponds to a portion on which the external electrodes are arranged, the rare gas fluorescent lamp comprises a creeping discharge prevention unit that is provided inward of the conductive material in an axial direction to prevent diffusion of creeping discharge occurring between the conductive material and electrical charges stored on the inner surface of the light-emitting tube.

Accordingly, it is possible to prevent an effective light-emitting region from being reduced by securely suppressing the creeping discharge from being extensively diffused on an inner surface of the light-emitting tube even when the conductive material is provided to improve starting performance.

The creeping discharge prevention unit may be formed such that at least one of the external electrodes protrudes toward the outside of the light-emitting tube in a vicinity of an end of the at least one of the external electrodes.

Accordingly, dielectric polarization is suppressed in dielectric under the light-emitting tube in which the external electrode is protruded, such that only weak barrier discharge is formed. As a result, since the amount of negative and positive charges, which are respectively accumulated on an inner surface of dielectric on high voltage side and on an inner surface of dielectric on low voltage side under the light-emitting tube, is very small, it is possible to suppress the creeping discharge from being diffused between the charges and the conductive material.

The creeping discharge prevention unit may be formed such that a thickness of a wall of the light-emitting tube, which corresponds to at least one of the external electrodes is larger than that of the other portion, in a vicinity of an end of the at least one of the external electrodes.

Accordingly, it is possible to make electrostatic capacitance small under the thick portion of the light-emitting tube. As a result, since it is possible to make charges stored on an inner surface of a dielectric very small, thereby suppressing the creeping discharge from being diffused between the charges and the conductive material.

The creeping discharge prevention unit may be formed such that an additional member is interposed between the light-emitting tube and at least one of the external electrodes, in a vicinity of an end of the external electrode.

Accordingly, since electrostatic capacitance is reduced under part of the light-emitting tube in which the additional member is provided, it is possible to make charges stored on an inner surface of a dielectric very small, thereby suppressing the creeping discharge from being diffused between the charges and the conductive material.

The creeping discharge prevention unit may be formed such that a surface area per unit length of at least one of the external electrodes in an axial direction is less than a surface area per unit length of the other portion in the axial direction, in a vicinity of an end of the external electrode.

Accordingly, since electrostatic capacitance is reduced under the part of the light-emitting tube which corresponds to the portion having a small surface area, it is possible to make charges stored on an inner surface of a dielectric very small, thereby suppressing the creeping discharge from being diffused between the charges and the conductive material.

The creeping discharge prevention unit is formed such that a wall of the light-emitting tube which corresponds to at least one of the external electrodes protrudes toward inside or outside of the light-emitting tube, in a vicinity of an end of the at least one of the external electrode.

Accordingly, since a creeping distance from the conductive material to charges stored on an inner surface of the light-emitting tube is increased by a distance protruded along the inner surface, the creeping distance is longer compared to the conventional lamp. As a result, barrier discharge is formed under the protruded part of the light-emitting tube, such that charges are accumulated. However, since the distance from the charges stored on the inner surface of the light-emitting tube to the conductive material is elongated compared to the conventional structure, it is possible to prevent the effective light-emitting region from being reduced.

BRIEF DESCRIPTION OF THE DRAWINGS

These and other features and advantages of the present rare gas fluorescent lamp will be apparent from the following description taken in conjunction with the accompanying drawings, in which:

FIGS. 7A and 7B are views showing an example of a conventional rare gas fluorescent lamp.

DETAILED DESCRIPTION OF THE INVENTION

A rare gas fluorescent lamp according to the present invention is divided into two types as set forth below.

A first-type rare gas fluorescent lamp includes a creeping discharge prevention unit 4 for preventing electrical charges from being accumulated on an inner surface of a light-emitting tube 1 (under external electrodes) corresponding to portions at which external electrodes 21 and 22 are arranged, as shown in the following first embodiment (FIG. 1) to fourth embodiment (FIG. 4). A second-type rare gas fluorescent lamp includes a creeping discharge prevention unit 4 that extends a creeping distance, as shown in the following fifth embodiment (FIGS. 5A and 5B) and sixth embodiment (FIG. 6).

The creeping discharge prevention unit 4 shown in the sixth embodiment (FIG. 6) includes a unit for preventing electrical charges from being accumulated on an inner surface (under the external electrodes) of the light-emitting tube 1 corresponding to portions at which external electrodes 21 and 22 are provided, and a unit for extending the creeping distance.

A first embodiment of the present invention will be described with reference to FIG. 1.

Figure 1:
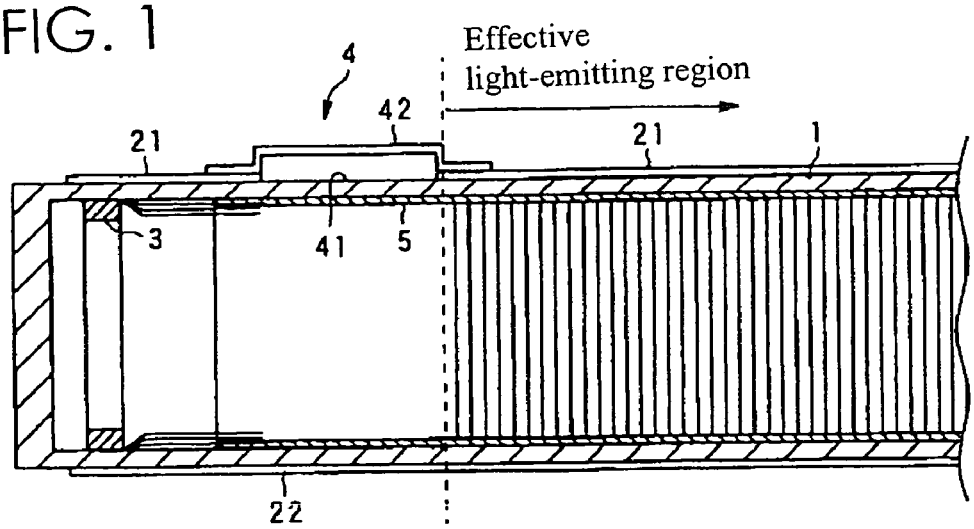
FIG. 1 is a partial cross-sectional view of a rare gas fluorescent lamp in an axial direction according to a first embodiment of the present invention.

FIG. 1 is a partial cross-sectional view of a rare gas fluorescent lamp in an axial direction according to the present embodiment. The rare gas fluorescent lamp includes a light-emitting tube 1, on its inner surface of which a fluorescent material 5 is coated and in which rare gases is filled, external electrodes 21 and 22, which are made from an aluminum tape or the like provided on an outer surface of the light-emitting tube 1, a conductive material 3, which is provided on an inner surface of an end portion of the light-emitting tube 1 in an O-ring or C-ring shape so as to correspond to portions on which the external electrodes 21 and 22 are provided, a creeping discharge prevention unit 4, which is provided closer to a central portion than the conductive material 3 in the vicinity of the conductive material 3 to prevent diffusion of creeping discharge occurring between the conductive material 3 and electrical charges stored on an inner surface of the light-emitting tube 1, a notch 41, which is provided on part of the external electrode 21, a conductive protrusion 42, which is provided over the notch 41 of the external electrode 21 and does not contact the light-emitting tube 1, and a fluorescent material 5, which is coated on an inner surface of the light-emitting tube 1.

As shown in FIG. 1, at least one of the external electrodes 21 includes the conductive protrusion 42 having approximately a 'U' shaped section that is not in contact with the light-emitting tube 1 in the vicinity of a portion corresponding to the conductive material 3. For example, the 'U'-shaped protrusion 42 made from a copper sheet is closely in contact with the external electrode 21 made from an aluminum tape. As shown in the drawing, the protrusion 42 may be formed to be connected to the external electrode 21, crossing the notch 41. Alternatively, the protrusion may be formed as part of the external electrode 21 made from a thick aluminum tape instead of providing the notch 41. In addition, the protrusion 42 may be provided on both of the external electrodes 21 and 22 instead of providing on any one of the external electrodes 21 and 22.

In the creeping discharge prevention unit 4 according to the present embodiment, when the external electrode 21 on a side on which the protrusion 42 is provided is at a high voltage, since the external electrode 21 is not in contact with the light-emitting tube 1 at the protrusion 42, dielectric polarization is suppressed in a dielectric on the high voltage side under the protrusion 42, such that only weak barrier discharge is formed. As a result, since the amount of negative and positive charges, which are respectively accumulated on an inner surface of the dielectric on high voltage side and on an inner surface of a dielectric on low voltage side, is very small on the inner surface of the light-emitting tube 1 under the protrusion 42, it is possible to suppress the creeping discharge from being spread between the charges and the conductive material 3.

A second embodiment of the present invention will be described with reference to FIG. 2.

Figure 2:
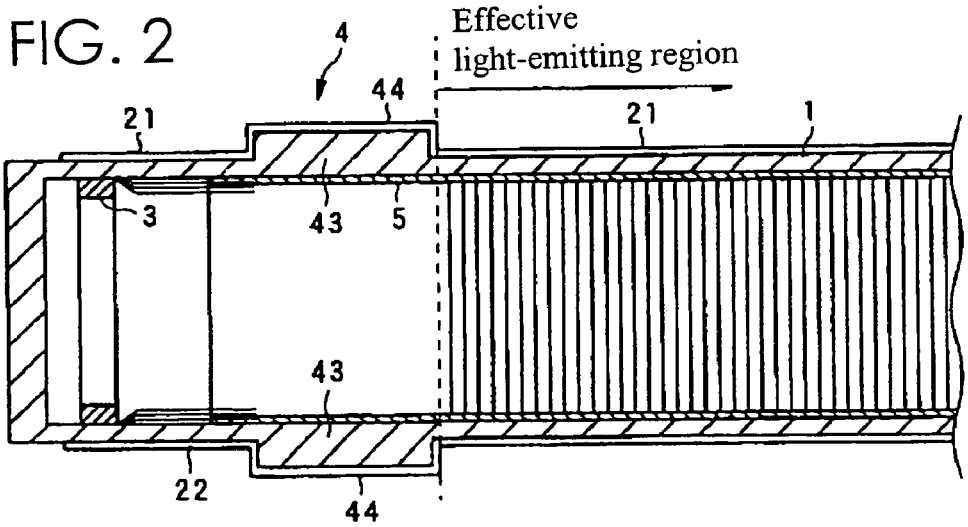
FIG. 2 is a partial cross-sectional view of a rare gas fluorescent lamp in an axial direction according to a second embodiment of the present invention.

FIG. 2 is a partial cross-sectional view of a rare gas fluorescent lamp in an axial direction according to the present embodiment. The rare gas fluorescent lamp includes light-emitting tube 1 having a thick portion 43, in which the thickness of the thick portion 43 is larger than other portion of the light-emitting tube in a direction perpendicular to a tube axis and in a direction opposite to a light-emitting space, and a protrusion 44, which is a protruding portion of each external electrode and is provided on an outer surface of the thickness portion 43. The other structural elements of the lamp are the same as those of FIG. 1 and the same reference numerals are used therefor. The thickness portions 43 are formed by performing a heating process on part of the light-emitting tube 1 by means of, for example, a burner.

As shown in the above drawing, each of the external electrodes 21 and 22 includes the protrusion 44, which has approximately a 'U'-shaped portion in a cross-section view including a tube axis and is formed to cover the thickness portion 43 in the light-emitting tube 1, and is provided to cover the thickness portion 43 and other portion of the light-emitting tube 1.

In the creeping discharge prevention unit 4 according to the present embodiment, it is possible to make electrostatic capacitance of a portion under the thickness portion 43 small, thereby making electrical charges stored on an inner surface of a dielectric small. Accordingly, it is possible to prevent diffusion of the creeping discharge between the charges and the conductive material 3.

In addition, the thick portion 43 of the light-emitting tube 1 may be formed toward the light-emitting space side instead of the opposite direction to the light-emitting space. In this case, it is possible to obtain the same effect as that obtained from the creeping discharge prevention unit shown in FIGS. 4 and 5.

A third embodiment of the present invention will be described with reference to FIG. 3.

Figure 3:
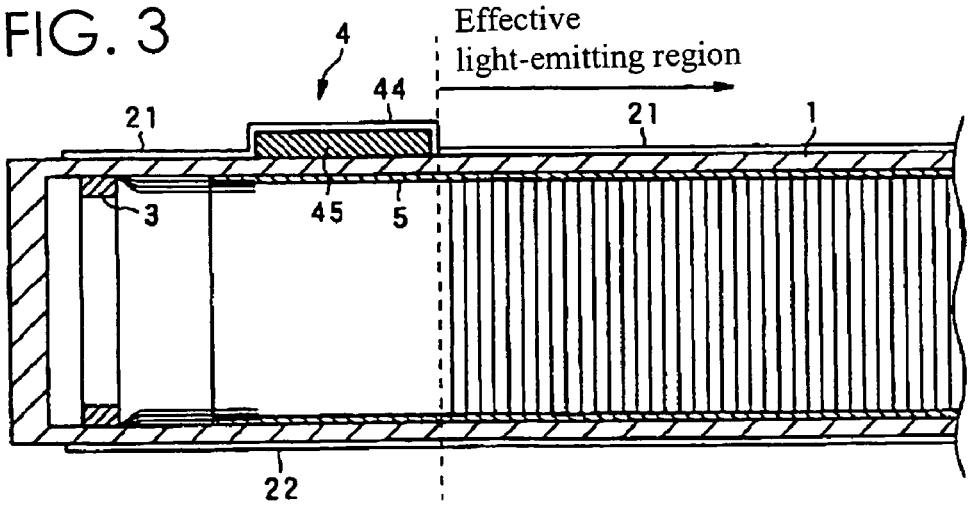
FIG. 3 is a partial cross-sectional view of a rare gas fluorescent lamp in an axial direction according to a third embodiment of the present invention.

FIG. 3 is a partial cross-sectional view of a rare gas fluorescent lamp in an axial direction according to the present embodiment. In FIG. 3, an additional member 45 is interposed between the external electrode 21 and the light-emitting tube 1 in the vicinity of an end portion of the external electrode 21. The other structural elements are the same as those shown in FIG. 2 and the same reference numerals are used therefor.

As shown in FIG. 2, an additional member 45, which is made of an insulation member different from the light-emitting tube 1 is provided on the light-emitting tube 1, in a direction perpendicular to a tube axis and opposite to a light-emitting space. The additional member 45 is made of a high-resistive material, such as resin, ceramic, or semiconductor, and is fixed to the light-emitting tube 1 by the use of an adhesive. The external electrode 21 includes the protrusion 44, which has approximately a 'U'-shaped section and is formed to cover the additional member 45, and other portion of the light-emitting tube 1.

In the creeping discharge prevention unit 4 according to the present embodiment, since electrostatic capacitance is reduced under the portion of the light-emitting tube 1 in which the additional member 45 is provided, it is possible to make charges stored on an inner surface of a dielectric very small, thereby suppressing the creeping discharge from being diffused between the charges and the conductive material 3.

A fourth embodiment of the present invention will be described with reference to FIG. 4.

Figure 4A:
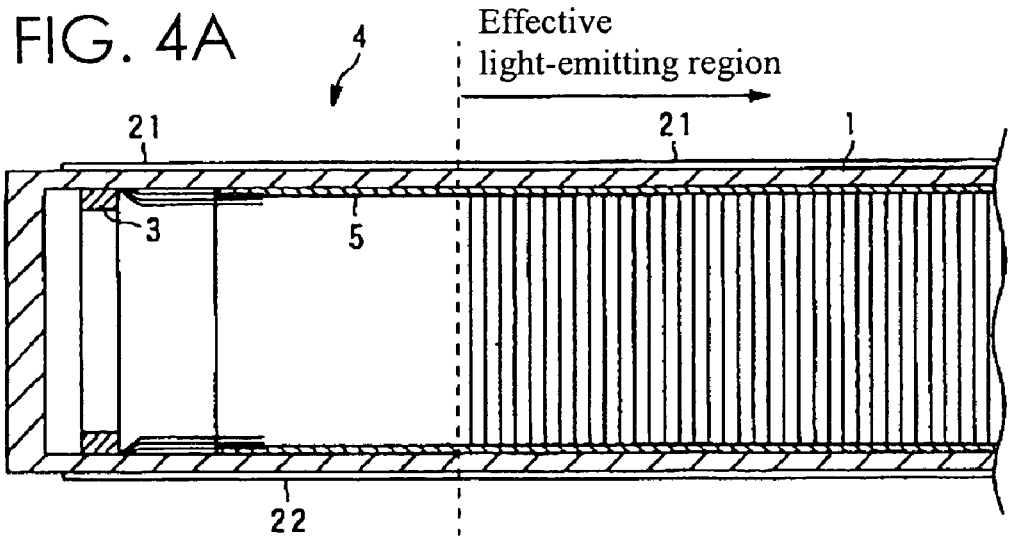
FIGS. 4A and 4B show a rare gas fluorescent lamp according to a fourth embodiment of the present invention.
Figure 4B:
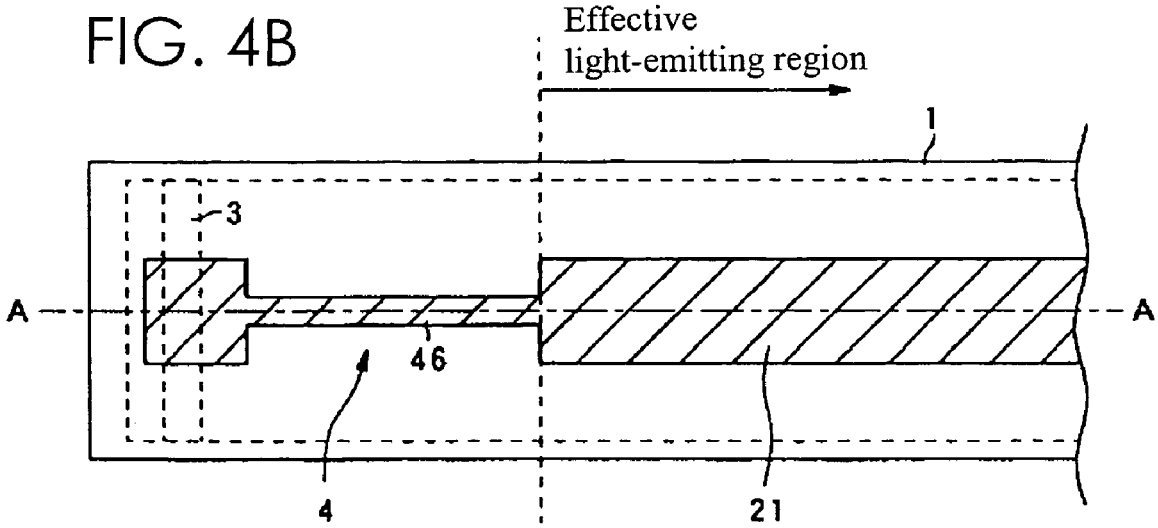

FIG. 4A is a partial cross-sectional view of a rare gas fluorescent lamp in an axial direction according to the present embodiment. FIG. 4B is a top plan view of the rare gas fluorescent lamp according to the present embodiment. In the FIGS. 4A and 4B, a narrow portion 46 is formed in the external electrode 21. The other structural elements are the same as those shown in FIG. 1 and the same reference numerals are used therefor.

As shown in FIGS. 4A and 4B, at least one of the external electrodes 21 has the narrow portion 46, which is decreased in width compared to other portion of the electrode, in the vicinity of a portion corresponding to the conductive material 3. Thus, in the narrow portion 46, a surface area per unit length of the light-emitting tube 1 in an axial direction is smaller than that of the other portion in the direction. The narrow portion 46 is formed by cutting out part of the external electrode 21 made of, for example, an aluminum tape along a longitudinal direction of the external electrode 21. If the width of the external electrode 21 corresponding to a position overlapping with the conductive material 3 is too small, it is not possible to securely generate preliminary discharge. Thus, the external electrode 21 needs to have the width required to ensure starting performance.

In the creeping discharge prevention unit 4 according to the present embodiment, since electrostatic capacitance is reduced under the narrow portion 46, it is possible to make charges stored on an inner surface of a dielectric very small, thereby suppressing the creeping discharge from being diffused between the charges and the conductive material 3.

In addition, the same effect as that in the present embodiment can be obtained by making holes in a portion where a surface area needs to be reduced.

A fifth embodiment of the present invention will be described with reference to FIGS. 5A and 5B.

Figure 5A:
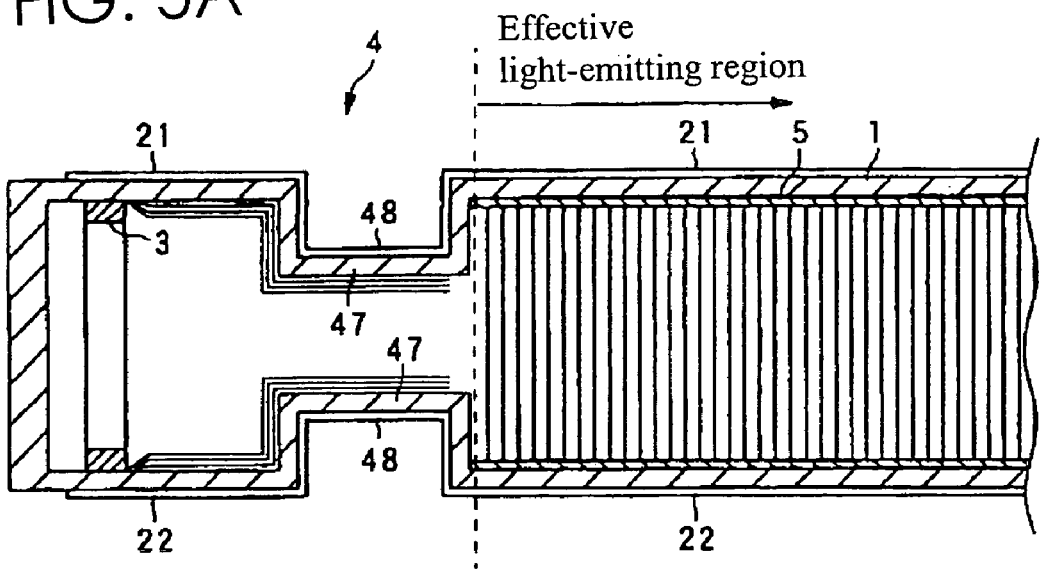
FIGS. 5A and 5B are partial cross-sectional views of a rare gas fluorescent lamp in an axial direction; according to a fifth embodiment of the present invention.
Figure 6:
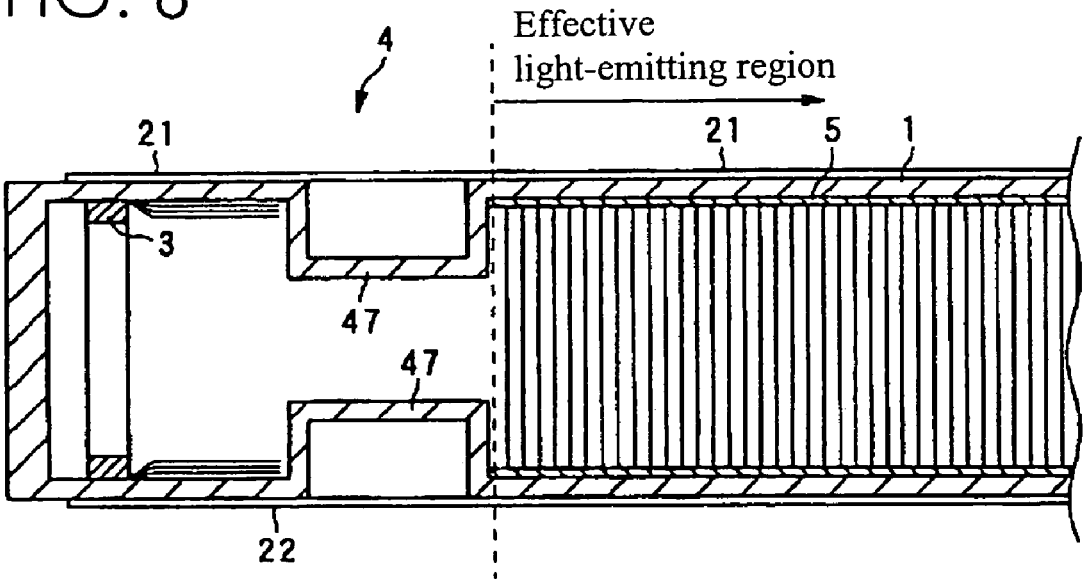
FIG. 6 is a partial cross-sectional view of a rare gas fluorescent lamp in an axial direction according to a sixth embodiment of the present invention.
Figure 8:
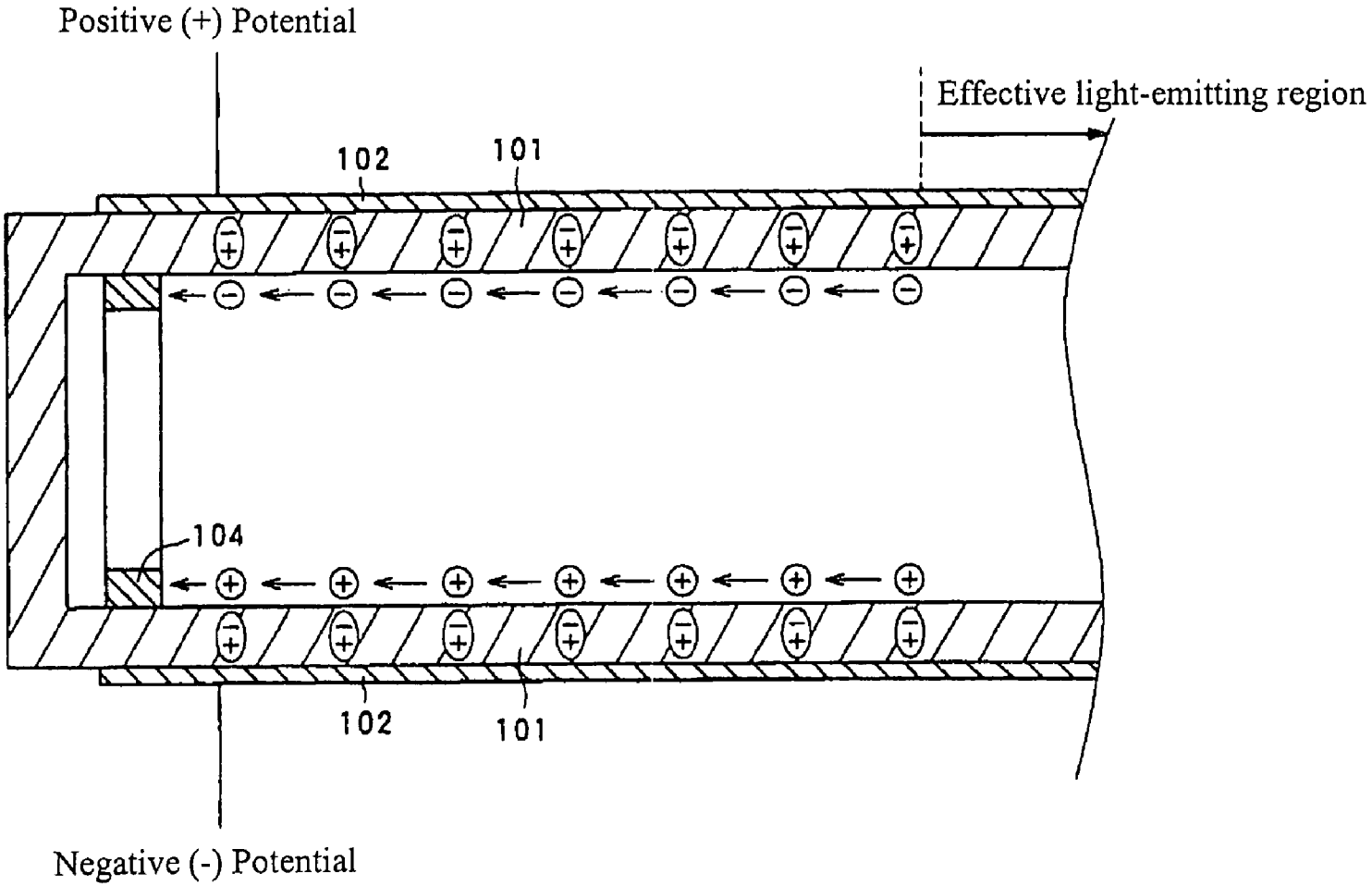
FIG. 8 is a view explaining the reason that creeping discharge is extensively generated on an end portion of a light-emitting tube.

FIG. 5A is a partial cross-sectional view of a rare gas fluorescent lamp in an axial direction according to the present embodiment. In FIG. 5A, a protrusion 47 is formed by protruding inward part of the light-emitting tube 1 in the vicinity of an end portion of the external electrodes 21 and 22, and a protrusion 48 of each of the external electrodes 21 and 22 corresponds to the protrusion 47. The other structural elements are the same as those shown in FIG. 1 and the same reference numerals are used therefore.

As shown in FIG. 5A, the light-emitting tube 1 includes the protrusion 47 having a 'U' shaped section which is protruded to a light-emitting space in a direction perpendicular to a tube axis and is provided around the light-emitting tube 1. Each of the external electrodes 21 and 22 includes the protrusion 48 having a 'U' shaped section on a portion which corresponds to the protrusion 47 and is provided along an outer surface of the light-emitting tube 1. The protrusion 47 is formed by performing a heating process on part of the outer surface of the light-emitting tube 1 by means of, for example, a burner.

In the creeping discharge prevention unit 4 according to the present embodiment, since a creeping distance from the conductive material to charges stored on an inner surface of the light-emitting tube on the inner surface of the light-emitting tube 1 is increased by a distance protruded along the inner surface of the protrusion 47, the creeping distance is longer compared to the conventional lamp. As a result, barrier discharge is formed under the protrusion 47, such that charges are accumulated. However, since the distance from the charges stored on the inner surface of the light-emitting tube 1 to the conductive material 3 is elongated compared to the conventional structure, it is possible to prevent reduction of the effective light-emitting region.

Figure 5B:
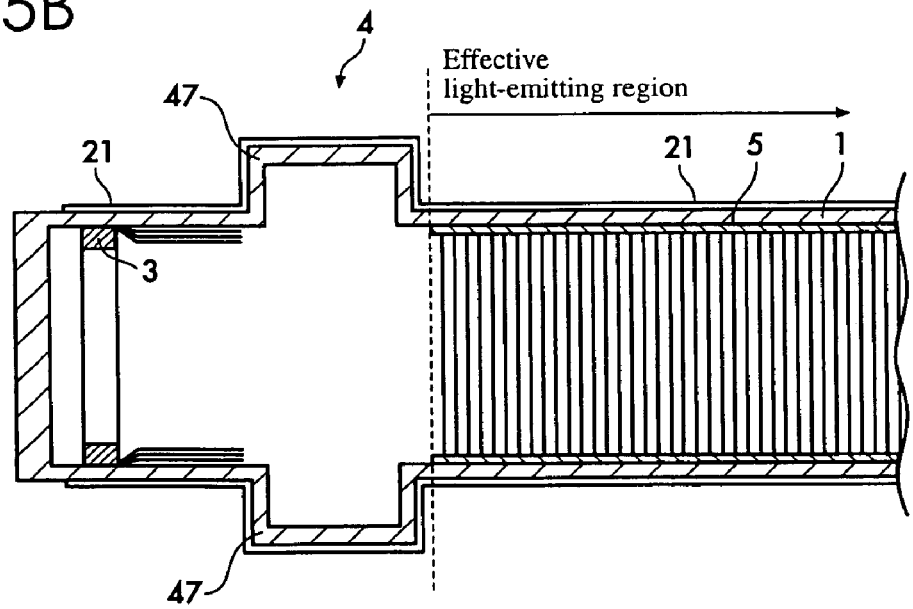

In addition, as shown in FIG. 5B, the protrusion 47 in the light-emitting tube 1 may be formed toward an opposite direction of a light-emitting space instead of being formed toward the light-emitting space side.

A sixth embodiment of the present invention will be described with reference to FIG. 6. FIG. 6 is a partial cross-sectional view of a rare gas fluorescent lamp in an axial direction according to the present embodiment. The other structural elements are the same as those shown in FIG. 5A and the same reference numerals are used therefor.

As shown in FIG. 6, the light-emitting tube 1 includes the protrusion 47 having a 'U' shaped section which is protruded to a light-emitting space in a direction perpendicular to a tube axis and is provided around the light-emitting tube 1. Each of the external electrodes 21 and 22 is formed in a straight section and is provided on an outer surface of portions other than the protrusion 47 without contacting the protrusion 47 provided on the light-emitting tube 1. That is, a space is interposed between the protrusion 47 and the external electrodes 21 and 22 in the light-emitting tube 1.

In the creeping discharge prevention unit 4 according to the present embodiment, when the external electrode 21 with the protrusion 47 provided is at a high voltage, the external electrode 21 is not in contact with the light-emitting tube 1 at the protrusion 47. Accordingly, dielectric polarization is suppressed in a dielectric on the high voltage side under the protrusion 47, such that only weak barrier discharge is formed. As a result, since the amount of negative and positive charges, which are respectively accumulated on an inner surface of a dielectric on high voltage side and on an inner surface of a dielectric on low voltage side, is very small on the inner surface of the light-emitting tube 1 under the protrusion 47, it is possible to suppress the creeping discharge from being diffused between the charges and the conductive material 3. In addition, since the light-emitting tube 1 includes the protrusion 47 and the distance from the charges stored on the inner surface of the light-emitting tube 1 to the conductive material 3 is elongated compared to the conventional structure, it is possible to prevent reduction of the effective light-emitting region.

Experimental results of the rare gas fluorescent lamp according to the present invention will be described.

EXAMPLE 1

According to the configuration shown in FIG. 1, four types of rare gas fluorescent lamps were prepared. In more detail, the light-emitting tubes 1 have an outer diameter of 8 mm or 10 mm, the emitting gas is Xe—Ne mixture gas having a ratio of Xe:Ne=2:8, and Xe has a partial pressure of 8 kPa or 12 kPa.

The light-emitting tube 1 has a length of 500 mm, and a thickness of 0.4 mm. Each of the external electrodes 21 and 22 is made from an aluminum tape. Each of the external electrodes 21 and 22 has almost the same length as the light-emitting tube, and has a width of 1 mm.

The conductive material 3 corresponds to the external electrodes 21 and 22. The conductive material 3 is provided on an end portion of the external electrodes 21 and 22 and has a width of about 1 mm.

EXAMPLE 2

Finally, According to the configuration shown in FIG. 3, four types of rare gas fluorescent lamps were provided to have the same specification as Example 1. A phenolic resin is used as the additional member 45 and is provided at a position which is 4 to 5 m distant from the conductive material 3.

EXAMPLE 3

According to the configuration shown in FIG. 4, four types of rare gas fluorescent lamps were provided to have the same specification as Example 1. The narrow portion 46 has a width of 0.5 mm.

EXAMPLE 4

According to the configuration shown in FIG. 5, four types of rare gas fluorescent lamps were provided to have the same specification as Example 1.

COMPARATIVE EXAMPLE

According to the configuration shown in FIG. 7A, four types of rare gas fluorescent lamps were prepared to have the same specification as Example 1.

Comparing the above-mentioned examples 1 to 4 and the comparative example, when the rare gas fluorescent lamps according to Examples 1 to 4 were turned on with an input power of 5 W to 10 W, the starting performance was not deteriorated when the creeping discharge prevention unit 4 on the light-emitting tube has a length of 3 to 9 mm. In addition, the light intensity was not reduced in a region which is more than 15 mm distant from both ends of the light-emitting tube. On the other hand, in the rare gas fluorescent lamp according to the comparative example, the light intensity was decreased in a region which is 40 mm distant from both ends of the light-emitting tube.

Although only some exemplary embodiments have been described in detail above, those skilled in the art will readily appreciate that many modifications are possible in the exemplary embodiments without materially departing from the novel teachings and advantages. Accordingly, all such modifications are intended to be included within the scope.

What is claimed is:

1. A rare gas fluorescent lamp comprising:

a light-emitting tube whose inner surface is coated with a fluorescent material, and which has a discharge space therein, wherein the discharge space is filled with a rare gas;

a plurality of external electrodes which are provided on an outer surface of the light-emitting tube; and a conductive material, which is provided in the discharge space at an end in an axis direction of the light-emitting tube and on an inner surface of the light-emitting tube that corresponds to portions on which the external electrodes are arranged, so that the inner surface of the light-emitting tube that corresponds to the portions on which the external electrodes are arranged is short circuited by the conductive material, the rare gas fluorescent lamp further comprising:

a creeping discharge prevention unit that is provided in an inward side of the conductive material in an axial direction to prevent diffusion of creeping discharge occurring between the conductive material and electrical charges stored on the inner surface of the light-emitting tube whereby charges which are accumulated on the inner surface of the light emitting tube under the creeping discharge prevention unit are reduced.

2. The rare gas fluorescent lamp according to claim 1, wherein the creeping discharge prevention unit is formed such that at least one of the external electrodes protrudes toward the outside of the light-emitting tube in a vicinity of an end of the at least one of the external electrodes.

3. The rare gas fluorescent lamp according to claim 1, wherein the creeping discharge prevention unit is formed such that a thickness of a wall of the light-emitting tube, which corresponds to at least one of the external electrodes is larger than that of the other portion, in a vicinity of an end of the at least one of the external electrodes.

4. The rare gas fluorescent lamp according to claim 1, wherein the creeping discharge prevention unit is formed such that an additional member is interposed between the light-emitting tube and at least one of the external electrodes, in a vicinity of an end of the external electrode.

5. The rare gas fluorescent lamp according to claim 1, wherein the creeping discharge prevention unit is formed such that a surface area per unit length of at least one of the external electrodes in an axial direction is less than a surface area per unit length of the other portion in the axial direction, in a vicinity of an end of the external electrode.

6. The rare gas fluorescent lamp according to claim 1, wherein the creeping discharge prevention unit is formed such that a wall of the light-emitting tube which corresponds to at least one of the external electrodes protrudes toward inside or outside of the light-emitting tube, in a vicinity of an end of the at least one of the external electrode.

7. A fluorescent lamp, comprising:

a light-emitting tube having a discharge space therein;

at least one external electrode provided on the lighting tube;

a conductive material, which is provided in the discharge space at an end in an axis direction of the light-emitting tube and on an inner surface of the light-emitting tube that corresponds to a portion on which the at least one external electrode is provided, wherein the inner surface of the light-emitting tube is short circuited around the end in the axis direction of the discharge space by the conductive material, wherein the at least one external electrode has a protrusion that is protruded from other portion of the at least one external electrode, and is provided in an inward side of the conductive material in the axis direction and is protruded upward from an outer surface of the at least one external electrode, whereby charges which are accumulated on the inner surface of the light emitting tube under the protrusion are reduced.

8. The fluorescent lamp according to claim 7, wherein part of the light-emitting tube is protruded so as to fit in the protrusion.

9. The fluorescent lamp according to claim 7, wherein high-resistive material is interposed between the at least one external electrode and the light-emitting tube.

10. A fluorescent lamp, comprising:

a light-emitting tube having a discharge space therein;

at least one external electrode provided on the lighting tube;

a conductive material, which is provided in the discharge space at an end in an axis direction of the light-emitting tube and on an inner surface of the light-emitting tube that corresponds to a portion on which the at least one external electrode is provided, wherein the inner surface of the light-emitting tube is short circuited around the end in the axis direction of the discharge space by the conductive material, wherein part of the at least one external electrode is cut out at a vicinity of the conductive material and a conductive protrusion is provided so as to bridge both ends of the electrodes near the cut out portion, whereby charges which are accumulated on the inner surface of the light emitting tube under the cut out part are reduced.

11. A fluorescent lamp, comprising:

a light-emitting tube having a discharge space;

at least one external electrode provided on the lighting tube;

a conductive material, which is provided in the discharge space at an end portion in an axis direction of the light-emitting tube and on an inner surface of the light-emitting tube that corresponds to a portion on which the at least one external electrode is provided, wherein the inner surface of the light-emitting tube is short circuited around the end in the axis direction of the discharge space by the conductive material, and wherein the light-emitting tube is protruded into the discharge space of the light-emitting tube, whereby charges which are accumulated on the inner surface of the light emitting tube under the cut out part are reduced.

12. The fluorescent lamp according to claim 11, wherein the at least one external electrode is provided so as to fit in the protruded portion of the light-emitting tube.

13. The fluorescent lamp according to claim 11, wherein the at least one external electrode is provided over the protruded portion so as to bridge both ends of the protruded portion of the light emitting tube.

* * * * *